United States Patent [19]

Huebner et al.

[11] 3,954,094

[45] May 4, 1976

[54] IGNITION DISTRIBUTOR ROTOR

[75] Inventors: Charles H. Huebner, Royal Oak; Allen G. Schroeder, Livonia, both of Mich.

[73] Assignee: General Motors Corporation, Detroit, Mich.

[22] Filed: Nov. 25, 1974

[21] Appl. No.: 526,627

[52] U.S. Cl. ..... 123/146.5 A; 200/19 A

[51] Int. Cl.[2] ..... H01H 19/12

[58] Field of Search ..... 123/146.5 A, 146.5 R; 200/19 A, 19 R, 19 DR

[56] References Cited

UNITED STATES PATENTS

| | | | |
|---|---|---|---|
| 2,227,972 | 1/1941 | Hood et al. | 200/19 A |
| 2,286,233 | 6/1942 | Scott | 200/19 WG |
| 2,593,205 | 4/1952 | Short et al. | 200/19 DR |
| 2,694,117 | 11/1954 | Bakke | 200/19 A |
| 3,591,736 | 7/1971 | Morgan et al. | 200/19 DC |
| 3,795,236 | 3/1974 | Jukes et al. | 123/146.5 |
| 3,799,155 | 3/1974 | House | 123/146.5 |
| 3,822,686 | 7/1974 | Gallo | 123/146.5 |

*Primary Examiner*—Wendell E. Burns
*Assistant Examiner*—James W. Cranson, Jr.
*Attorney, Agent, or Firm*—Richard G. Stahr

[57] ABSTRACT

To reduce the potential magnitude necessary to break down the distributor arc gap between the distributor movable output electrode carried by the distributor rotor and each of the stationary output electrodes of the distributor cap, a distributor movable output electrode of an electrically conductive material having a cross-sectional area so selected that the output tip is heated to incandescence by arc current is employed and is located within a surrounding thermal shield member of an electrically nonconductive and heat insulating material.

5 Claims, 4 Drawing Figures

IGNITION DISTRIBUTOR ROTOR

The subject invention is directed to an ignition distributor rotor and, more specifically, to an ignition distributor rotor having a movable output electrode of an electrically conductive material, having a cross-sectional area so selected that the output tip is heated to incandescence by arc current, located within a surrounding thermal shield member of an electrically nonconductive and heat insulating material.

It has been found that excessive radio noise is produced whenever a critical relationship exists between the electrical potential required to ionize and break down the distributor rotor gap and that of the spark plug gap. Further, it is believed that radio receivers respond to minimum time increments between two or more electrical discharges, less than 1 microsecond for example, to produce undesirable "noise". In the ignition systems of automotive type internal combustion engines, there is an electrical discharge across the distributor arc gap and also across each of the engine spark plugs. Therefore, an ignition distributor rotor which provides for a reduced breakdown potential of the distributor arc gap and, thereby, extends the time between the electrical discharge across the ignition distributor arc gap and the spark plug of the engine to which the ignition potential is directed to reduce radio frequency interference, is desirable.

It is, therefore, an object of this invention to provide an improved ignition distributor rotor.

It is another object of this invention to provide an improved ignition distributor rotor having a body member of a high dielectric strength electrically nonconductive material and a distributor movable output electrode of an electrically conductive material, having a cross-sectional area so selected that the output tip thereof is heated to incandescence by arc current, located within a thermal shield member of an electrically nonconductive and heat insulating material.

In accordance with this invention, an ignition distributor rotor is provided having a body member of an electrically nonconductive material which carries the distributor movable output electrode of an electrically conductive material, having a cross-sectional area so selected that the output tip thereof is heated to incandescence by arc current, located within a surrounding thermal shield member of an electrically nonconductive and heat insulating material.

For a better understanding of the present invention, together with additional objects, advantages and features thereof, reference is made to the following description and accompanying drawing in which.

In the several FIGURES of the drawing, like elements have been assigned like numerals of reference.

Figure 1:
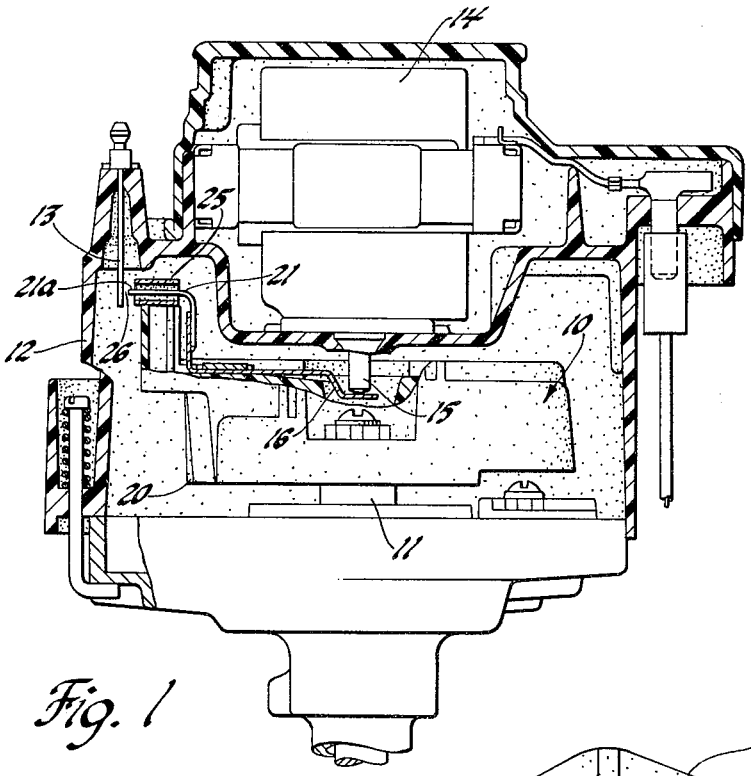
FIG. 1 is a view, partially in cross-section, of an ignition distributor having the improved distributor rotor of this invention.
Figure 2:
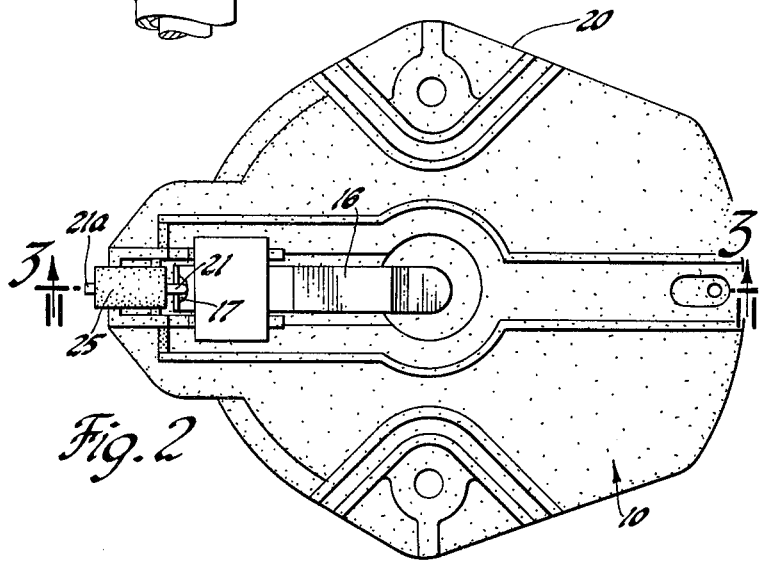
FIG. 2 is a top view of the improved distributor rotor of this invention.
Figure 3:
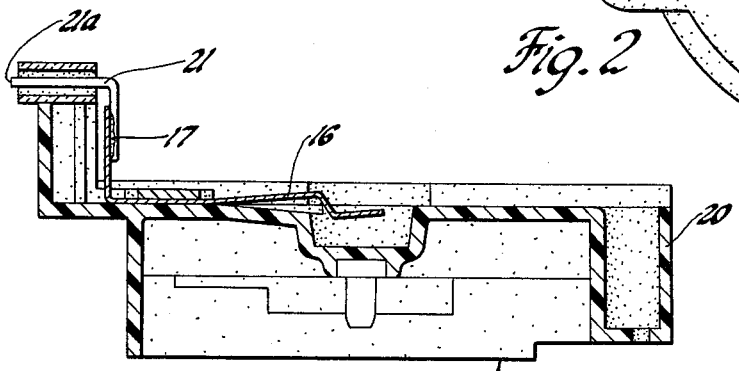
FIG. 3 is a cross-sectional view of FIG. 2 taken along line 3—3 and looking in the direction of the arrows.
Figure 4:
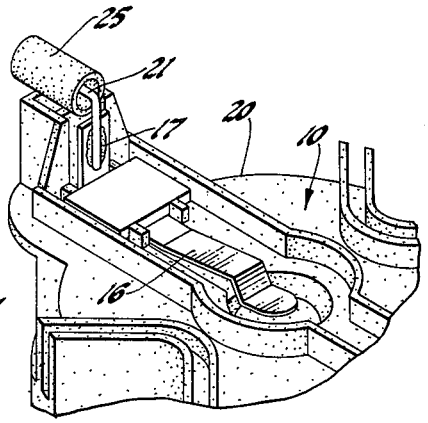
FIG. 4 is a fragmentary perspective view of the improved distributor rotor of this invention.

As is well known in the automotive art, the ignition distributor rotor 10, FIG. 1, is rotated by a driving shaft 11, usually gear-coupled to the camshaft of the associated internal combustion engine, within a distributor cap 12. Although only one stationary distributor output terminal 13 is illustrated in FIG. 1, it is well known in the automotive art that the ignition distributor cap 12 has a plurality of circumferentially arranged stationary distributor output terminals, one for each spark plug of the associated engine. Each engine spark plug is connected to the corresponding stationary distributor output terminal through a respective spark plug lead.

The ignition distributor rotor of this invention comprises a body member 20 of an electrically nonconductive material adapted to engage and be rotated by driving shaft 11, a distributor movable output electrode 21 of an electrically conductive material supported by body member 20 and located within a thermal shield member 25 of an electrically nonconductive and heat insulating material which completely surrounds at least a portion of output electrode 21. The output tip portion 21*a* of the distributor movable output electrode 21 is passed in arc gap relationship with successive ones of the stationary distributor output terminals of distributor cap 12 as body member 20 is rotated by shaft 11, as is well known in the automotive art. In FIG. 1, the distributor arc gap between the distributor movable output electrode 21 and stationary output terminal 13 is referenced by the numeral 26. It is to be understood that there is a distributor arc gap between distributor movable contact 21 and each of the other stationary distributor output electrodes with which it is moved into arc gap relationship by rotor 10.

In FIG. 1, an ignition distributor of the type having a cap mounted ignition coil 14 is illustrated. The end of the secondary winding of ignition coil 14 from which the high ignition potential is taken and directed to the spark plugs of the engine in sequence is connected to carbon brush 15 which is in electrical contact with spring electrode 16 of the ignition distributor. Spring electrode 16 is an elongated electrode made of a springlike electrically conductive material, such as AISI stainless steel No. 301, and is electrically connected to the distributor movable output electrode 21 through solder 17 or any other suitable electrically conductive connection.

As the discharge across the distributor arc gaps is thermionic in nature, to reduce the potential required to ionize and break down the distributor arc gaps, distributor movable output electrode 21 may be heated. The most practical way to heat the distributor movable output electrode 21 is with the current of the ignition arc. Therefore, the cross-sectional area of distributor movable output electrode 21 is so selected that, considering the resistivity of the electrically conductive material employed, it will have an electrical resistance of such a value that the watts produced by arc current flow therethrough will be of a level which will heat at least output tip 21*a*. Preferably, output tip 21*a* is heated substantially to incandescence. The cross-sectional area required may be computed by considering the resistivity of the material employed for distributor movable output electrode 21 and the arc current. To minimize the forced convection heat loss of distributor movable output electrode 21 as rotor 10 is roated by shaft 11, it may be located within a surrounding thermal shield member 25 which should be of an electrically nonconductive and heat insulating material, such as a ceramic material.

In a practical application of the distributor rotor of this invention, distributor movable output electrode 21 was made up of AISI type No. 302 stainless steel wire of a circular cross-section 0.202 inches in diameter and thermal shield member 25 was made up of a ceramic tube having an inside diameter of 0.120 inch. Distributor movable output electrode 21 was centered along the axial bore of thermal shield member 25. In actual experimental tests, the potential required to ionize and break down ignition distributor gap 26 was reduced to 4.50 kilovolts for a distributor rotor gap having a nominal value of 0.075 inch.

It is to be specifically understood that distributor movable output electrode 21 need not be of a circular cross-section but may be of a rectangular or square cross-section without departing from the spirit of the invention, it being only necessary that the cross-sectional area be selected to be such that the output tip 21*a* is heated by arc current. Similarly, thermal shield member 25 need not be tubular but may be of any suitable shape or form which surrounds at least a portion of distributor movable output electrode 21 for the purpose of minimizing the forced convection heat loss of distributor movable output electrode 21 as the rotor 10 is rotated by shaft 11.

It appears that the electrically conductive material selected for arc gap output electrode 21 should have the following characteristics: (1) low specific heat capacity; (2) low thermal conductivity; and (3) low work function.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. An ignition distributor rotor of the automotive type comprising: a body member of an electrically non-conductive material; a distributor movable output electrode having an output tip supported by said body member, said output electrode being of an electrically conductive material; and a thermal shield member of an electrically non-conductive material completely surrounding and spaced from at least a portion of said output electrode.

2. An ignition distributor rotor of the automotive type comprising: a body member of an electrically non-conductive material; a circular cross-section distributor movable output electrode having an output tip supported by said body member, said output electrode being of an electrically conductive material; and a thermal shield member of an electrically non-conductive ceramic material completely surrounding at least a portion of said output electrode.

3. An ignition distributor rotor of the automotive type comprising: a body member of an electrically non-conductive material; a circular cross-section distributor movable output electrode having an output tip supported by said body member, said output electrode being of an electrically conductive material; and a tubular thermal shield member of an electrically non-conductive ceramic material completely surrounding at least a portion of said output electrode.

4. An ignition distributor rotor of the automotive type comprising: a body member of an electrically non-conductive material; a circular cross-section distributor movable output electrode having an output tip supported by said body member, said output electrode being of an electrically conductive material of a cross-sectional area so selected that said output tip is heated to incandescence by arc current; and a tubular thermal shield member of an electrically non-conductive material completely surrounding at least a portion of said output electrode.

5. An ignition distributor rotor of the automotive type comprising: a body member of an electrically non-conductive material; a circular cross-section distributor movable output electrode having an output tip supported by said body member, said output electrode being of an electrically conductive material of a cross-sectional area so selected that said output tip is heated to incandescence by arc current; and a tubular thermal shield member of an electrically non-conductive ceramic material completely surrounding at least a portion of said output electrode for minimizing said output electrode forced convection heat loss.

* * * * *